United States Patent [19]

Braun et al.

[11] Patent Number: 4,751,421

[45] Date of Patent: Jun. 14, 1988

[54] LAMP WITH CEMENT-FREE BASE STRUCTURE

[75] Inventors: Alfred Braun, Herbrechtingen; Walter Schönherr, Giengen-Hürben; Hermann Steiner, Herbrechtingen, all of Fed. Rep. of Germany

[73] Assignee: Patent Treuhand Gesellschaft für elektrische Glühlampen mbH, Munich, Fed. Rep. of Germany

[21] Appl. No.: 888,927

[22] Filed: Jul. 23, 1986

[30] Foreign Application Priority Data

Aug. 7, 1985 [DE] Fed. Rep. of Germany ..... 8522797

[51] Int. Cl.[4] ..... H01K 1/42; F21V 19/00

[52] U.S. Cl. ..... 313/318; 313/43; 313/44; 313/113; 313/315; 362/296

[58] Field of Search ..... 313/318, 51, 579, 113, 313/43, 44; 339/90 F, 91 L, 145 R, 145 T, 144 R, 276 R; 362/296

[56] References Cited

U.S. PATENT DOCUMENTS

| | | | |
|---|---|---|---|
| 4,146,814 | 3/1979 | Wojtowicz | 339/144 R X |
| 4,569,005 | 2/1986 | Bergin et al. | 313/318 X |
| 4,569,006 | 2/1986 | Bergin et al. | 313/318 X |
| 4,623,958 | 11/1986 | Van Der Linde et al. | 313/318 X |
| 4,641,056 | 2/1987 | Sanders et al. | 313/51 |
| 4,647,132 | 3/1987 | Mikola | 339/91 L |

FOREIGN PATENT DOCUMENTS 7516486 11/1976 Fed. Rep. of Germany .

OTHER PUBLICATIONS

CRC Handbook of Chemistry and Physics, 60th ed., 1980, pp. E392, E10.

*Primary Examiner*—David K. Moore
*Assistant Examiner*—Mark R. Powell
*Attorney, Agent, or Firm*—Frishauf, Holtz, Goodman & Woodward

[57] ABSTRACT

The bulb (1) of an incandescent lamp, such as a vehicular headlight, is mounted on a base structure (3) without cementing, by means of a securing element (2) having two shell-shaped halves (4). Each half (4) has a lug (5) on one side and bent tabs (6) on its other side which engage the lug (5) of the other half (4) to form a cuff around the pinch seal of the lamp and to connect the lamp to the base structure (3), which may be made of plastic. Each half (4) has a flange (8) with a projecting rim (10) whose curvature matches that of a tubular base structure (3). The projecting rim (10) has perforations (9) so that, if a plastic base structure (3) is used, the rim (10) can be connected to the base structure (3) by high-frequency heating, which causes the plastic to permeate the perforations (9) and harden therein.

15 Claims, 3 Drawing Sheets

LAMP WITH CEMENT-FREE BASE STRUCTURE

Cross Reference to related application, assigned to the assignee of the present application: German Utility Model DE-GM 75 16 486, filed May 23, 1975, published Nov. 25, 1976.

The present invention relates generally to electric lamps having a bulb, a pinch seal, power supply leads transversing the seal, and a base structure, and, more particularly, to a lamp in which the base structure and the bulb are interconnected by a securing element which surrounds the pinch seal and comprises a cuff or sleeve having two shell-like components.

BACKGROUND

German Utility Model DE-GM 75 16 486 discloses an automotive headlight lamp incorporating a cuff-like securing element composed of two shell-shaped halves, the halves being fastened to a securing ring by rivets or welds. The securing ring is connected with a metallic base sleeve by flanging or beading over of the rim. These numerous working steps make the manufacture of the securing element rather costly.

THE INVENTION

It is an object of the present invention to provide a cement-free based lamp in which a more simply constructed securing element fastens the bulb to the base structure. The base should be an inexpensive material, such as plastic.

Briefly, the present invention features a cuff-like securing element with two shell-shaped halves, on each of which is formed a flange, connected at its free end to the base structure. Thus, fabrication of the securing element requires only connecting two parts to each other.

Preferably, the flanges are formed on the ends of the cuff-like element adjacent to the bulb, specifically on the corresponding ends of the shell-shaped halves. The flanges are bent backwardly, so that the path for transmission of the heat generated by the lamp is as long as possible and so that high heat dissipation is assured. For the same purpose, at least one hole is provided in each flange, so that heat transmission to the base is reduced. Appropriate selection of the material of the securing element, e.g. a stainless steel, can further support the poor heat conductivity. Such measures are particularly advantageous because they permit using bases of plastic material which cannot tolerate excessively high temperatures.

The shell-shaped halves are provided with means on each side for connecting them together to form the cuff which surrounds the pinch seal of the lamp. Both halves are constructed identically, having a lug or projection on one side and tabs on the other side which can be bent over to grip the projection. Additional, partially stamped-out tabs on the shell-shaped halves co-operate with recesses in the pinch seal.

The free ends of the flanges, which match the curvature of the base tube opening, can be welded to the base tube, if it is of metal. For fastening to a plastic base tube, the free ends of the flanges each have a projecting rim provided with perforations. After connection of the securing element and plastic base structure by high frequency heating, the perforations are permeated with base material.

Bends or creases for stiffening of the flanges are preferably inclined to each other. This serves to satisfy standards (Federal Safety Standard MVSS No. 108) which specify maximum loading on the bulb, uncompensated, of 2.2 kilograms.

DRAWINGS

Further details will be apparent from the accompanying illustrations, in which.

DETAILED DESCRIPTION

Figure 1:
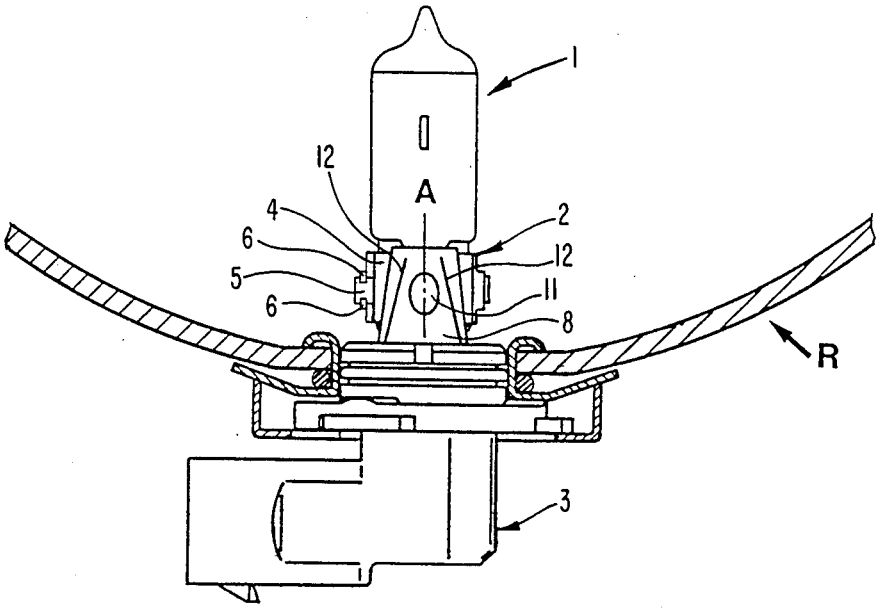
FIG. 1 is a side view of a single-filament halogen incandescent lamp for an automotive headlight.
Figure 2:
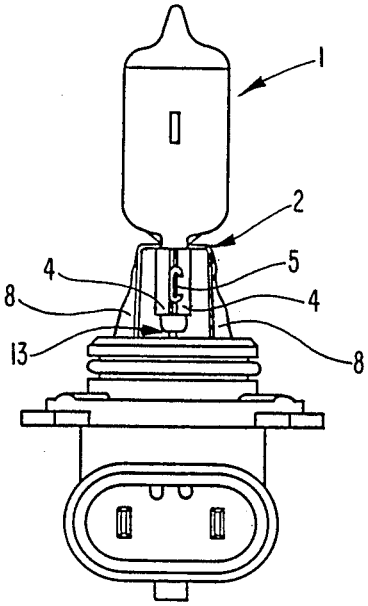
FIG. 2 is a side view, rotated 90°, of the same lamp.
Figure 3:
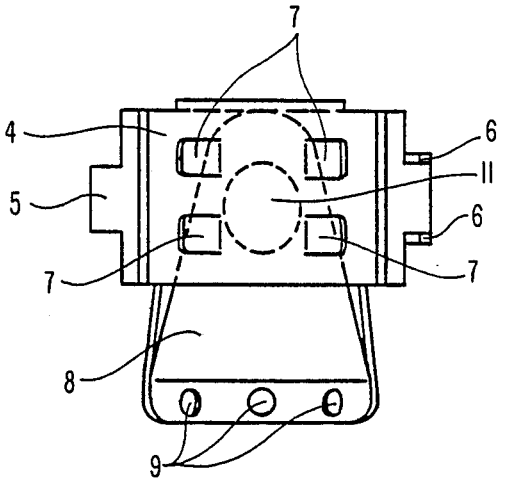
FIG. 3 is a side view of one of the shell-shaped halves of the securing element.
Figure 4:
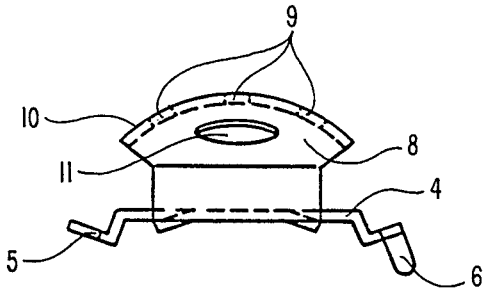
FIG. 4 is a top view of one of the shell-shaped halves of the securing element.

The vehicular headlamp shown in FIGS. 1 and 2 comprises a lamp bulb 1, a holding or securing element 2, and a base structure or component 3. The bulb 1 is held at its pinch seal by the securing element 2 and power supply leads 13 are traversing the seal. This securing element 2 (see also FIGS. 3 and 4) preferably comprises two identical shell-shaped halves 4, which have sidewise projections 5 and bent tabs 6. By means of these projections 5 and tabs 6, the halves 4 connect together into a cuff which surrounds the pinch seal. Additional, partially stamped-out tabs 7, which co-operate with receses in the pinch seal, give the connection a firm grasp. The lamp may be mounted in a reflector R.

At the upper ends of the shell-shaped halves 4 are formed flanges 8 which are bent backwardly. The free ends of these flanges 8 are connected to the base structure 3. In the embodiment shown, a base structure 3 of plastic is provided, and the connection between the securing element 2 and base structure 3 is made by high-frequency heating.

For this purpose, the free end of the flange 8 has a projecting rim 10 provided with perforations 9. Upon high frequency heating of the plastic base, rim 10 presses into the base material. The perforations 9 are consequently permeated with the base material.

Since even a high-quality plastic, such as a polyphenyl sulfide reinforced with glass fibers and mineral filling material, would not tolerate the heat produced by direct contact with the lamp, the heat conduction between lamp bulb 1 and base structure 3 must be as low as possible. For this reason, securing element 2 is made of a stainless steel which has a relatively poor heat conductivity. A hole 11 in each flange 8 further minimizes the heat transmission.

Bends or creases 12 on the flanges raise the stability of the securing element 2. Preferably, they are arranged at an angle to the longitudinal axis A of the flanges.

Various changes are possible within the scope of the inventive concept.

In addition to the aforementioned polyphenyl sulfide, an other suitable plastic for the base structure 3 is polyetherimide.

A suitable material for the securing element 2 is stainless steel of German Quality Grade No. 14301 (corresponding to SAE No. 30304) or of german quality grade No. 14016 (corresponding to SAE No. 51430).

This invention may be used in fabricating vehicular lamps, for example, of types 9004, 9005, 9006 and 9007.

What is claimed is:

1. A cement-free based electric lamp having a bulb (1);
a pinch seal;
power supply leads (13) traversing the pinch seal;
a base structure made of plastic (3), and
a securing element (2) surrounding the pinch seal and interconnecting said base structure (3) and said bulb (1), said securing element (2) comprising a cuff having two halves (4), each of which halves has a substantially rectangular portion and a substantially shell-shaped flange portion (8), said rectangular portion having one end adjacent said bulb and an opposite end remote from said bulb, said flange portion extending from the one end of said rectangular portion adjacent said bulb and bent at an angle to said substantially rectangular portion;
said substantially rectangular portions each engaging one side of said pinch seal and securing together mechanically around said pinch seal,
said flange portions each having a free end which is connected to said base structure (3).

2. A cement-free based electric lamp according to claim 1, wherein
said flanges (8) are bent at an angle of 180°.

3. A cement-free based electric lamp according to claim 1, wherein the flanges (8) are each formed with a central hole (11).

4. A cement-free based electric lamp according to claim 1, wherein
each of said rectangular portions has a sidewise projection (5) on one side and gripping tabs (6) at the opposite side, the tabs of each portion, upon assembly, bending around and gripping the projection of the other portion, thereby connecting said halves together and defining said cuff.

5. A cement-free based electric lamp according to claim 1, wherein
said securing element comprises two identical components.

6. A cement-free based electric lamp according to claim 1, wherein
said base structure (3) is tubular and formed with a circular opening at the end facing the securing element; and
the curvature of said free ends of said flanges (8) corresponds to that of said circular opening.

7. A cement-free based electric lamp according to claim 1, wherein
said free ends of said flanges (8) each are formed with a projecting rim (10) at the edge near the base structure.

8. A cement-free based electric lamp according to claim 7, wherein
said projecting rim (10) is provided with perforations (9).

9. A cement-free based electric lamp according to claim 8, wherein
said base structure (3) and said securing element are secured together by high-frequency heating; and
upon said heating, said perforations (9) become permeated with said base material.

10. A cement-free based electric lamp according to claim 1, wherein
said flanges (8) are provided with stiffening bends or creases (12).

11. A cement-free based electric lamp according to claim 10, wherein
said stiffening bends or creases (12) on said flanges (8) are oriented at an angle to the longitudinal axis (A) thereof.

12. A cement-free based electric lamp having
a bulb (1);
a pinch seal;
power supply leads (13) traversing the pinch seal;
a base structure (3), and
a securing element (2) surrounding the pinch seal and interconnecting said base structure (3) and said bulb (1),
the securing element (2) comprises a cuff having two halves (4);
wherein, in accordance with the invention,
each half (4) has a substantially rectangular portion and a substantially shell-shaped flange (8);
each flange has a free end which is connected to said base structure (3);
each flange is formed with
a central hole (11) and its free end is provided with
a projecting rim (10) at the edge near the base structure;
said projecting rim (10) is formed with perforations (9);
the material of said base structure (3) comprises plastic;
said base structure (3) and said securing element are secured together by high frequency heating; and
upon said heating, said perforations (9) become permeated with said base material.

13. A cement-free based electric lamp according to claim 12, wherein
said halves (4) are identical to each other and are formed with two opposing side edges, one of which has a projecting lug (5) thereon and the other of which has bent tabs (6) thereon, the tabs (6) of each half (4) bending over and gripping the lug (5) of the other half, thereby forming said securing cuff or element (2).

14. A cement-free based electric lamp having
a bulb (1);
a pinch seal;
power supply leads (13) traversing the pinch seal;
a base structure (3);
a securing element (2) surrounding the pinch seal and interconnecting said base structure (3) and said bulb (1), and
a curved reflector (R) spaced from said bulb (1), and surrounding said bulb (1) and securing element (2),
the securing element (2) comprises a cuff having two halves (4);
wherein each half (4) has a substantially rectangular portion and a substantially shell-shaped flange (8), said flange having a free end which is connected to said base structure and a central hole for minimizing heat transmission through said flange between the bulb and the base structure.

15. A cement-free based electric lamp according to claim 14, wherein
each flange has a free end which is connected to said base structure (3);
each flange
having its free end provided with a projecting rim (10) at the edge near the base structure;
said projecting rim (10) is formed with perforations (9);
the material of said base structure (3) comprises plastic;
said base structure (3) and said securing element are secured together by high frequency heating; and
upon said heating, said perforations (9) become permeated with said plastic material of said base structure (3).

* * * * *